US006242677B1

(12) United States Patent
Sander

(10) Patent No.: US 6,242,677 B1
(45) Date of Patent: Jun. 5, 2001

(54) PLECTRUM AUXILIARY DEVICE FOR STRING MUSICAL INSTRUMENTS

(75) Inventor: Noam Sander, Tel Aviv (IL)

(73) Assignee: Pro Music Developments Ltd. (IL)

( * ) Notice: Subject to any disclaimer, the term of this patent is extended or adjusted under 35 U.S.C. 154(b) by 0 days.

(21) Appl. No.: 09/601,603

(22) PCT Filed: Feb. 3, 1999

(86) PCT No.: PCT/IL99/00068

§ 371 Date: Aug. 3, 2000

§ 102(e) Date: Aug. 3, 2000

(87) PCT Pub. No.: WO99/40565

PCT Pub. Date: Aug. 12, 1999

(30) Foreign Application Priority Data

Feb. 4, 1998 (IL) ..... 123176

(51) Int. Cl.[7] ..... G10D 3/16

(52) U.S. Cl. ..... 84/322; 84/320; 84/319; 84/453

(58) Field of Search ..... 84/322, 320, 321, 84/315, 318, 319, 453

(56) References Cited

U.S. PATENT DOCUMENTS

| | | | | |
|---|---|---|---|---|
| 1,280,858 | * | 10/1918 | Russell | 84/319 |
| 3,735,663 | * | 5/1973 | Cowell, Sr. | 84/322 |
| 3,992,975 | | 11/1976 | Gallagher | 84/322 |
| 4,137,814 | | 2/1979 | Rowley | 84/322 |
| 4,944,766 | | 7/1990 | Williams | 623/65 |
| 4,957,442 | | 9/1990 | Prater | 434/322 |

FOREIGN PATENT DOCUMENTS

| | | | |
|---|---|---|---|
| 16901 | * | 6/1881 | (DE) . |
| 17843 | * | 8/1881 | (DE) . |
| 651683 | | 4/1951 | (GB) . |

* cited by examiner

*Primary Examiner*—Shih-Yung Hsieh
(74) *Attorney, Agent, or Firm*—Ostrolenk, Faber, Gerb & Soffen, LLP

(57) ABSTRACT

A plectrum holding device for playing the guitar and the like string musical instruments, comprising an elongated body member (12), a butt-like rear member (14) mounted to one end of the body member (12) and configured to rest against the thumb root of the player, a trigger-like front member (16) mounted to the other end of the body member (12) and configured to be gripped by a forefinger phalanxankle of the player; and a mounting (18) for plectrum (20) in a plane substantially perpendicular to the plane of rear and front members (14; 16) within reach of the player's thumb on one side and the tip of the player's forefinger on the other side of the plectrum mounting (18).

11 Claims, 5 Drawing Sheets

FIG.1
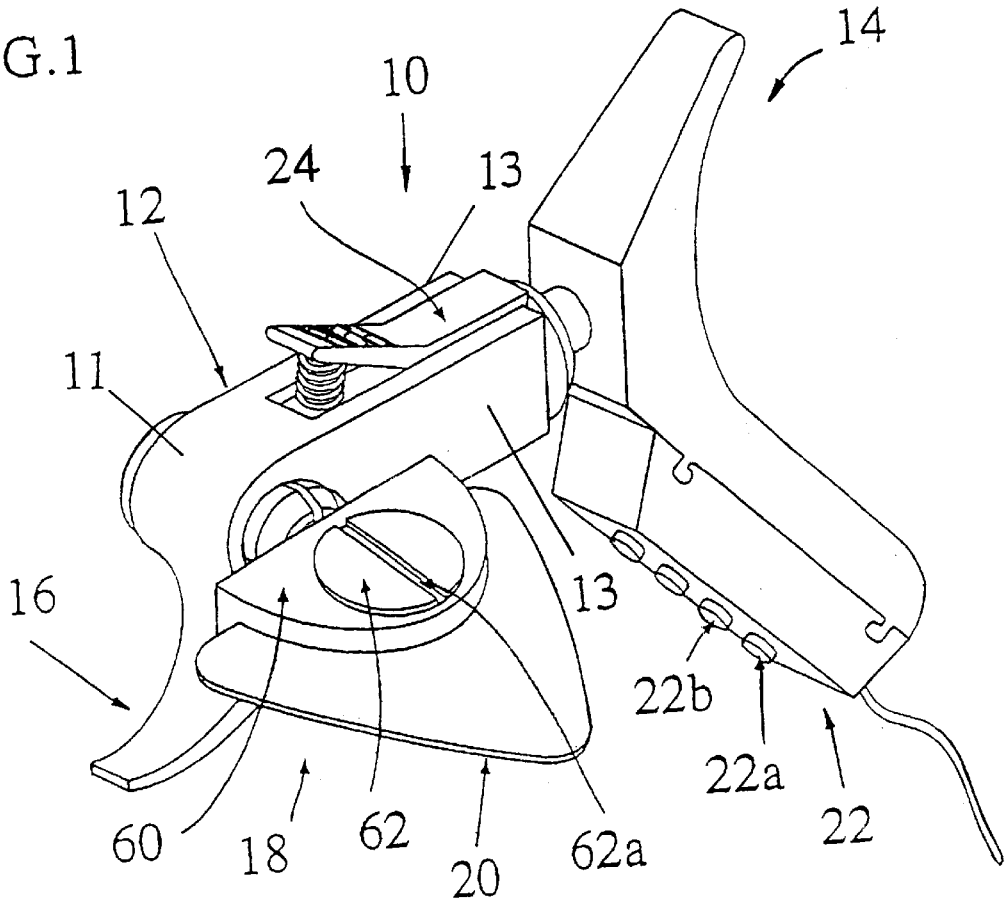
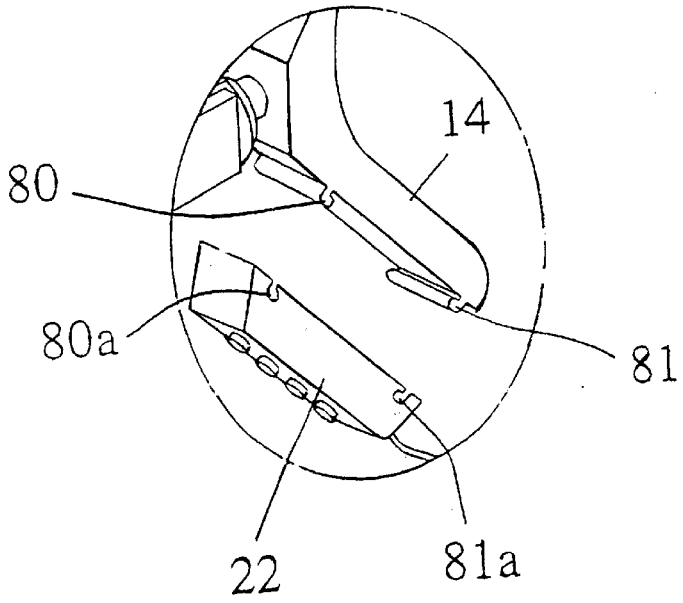
FIG.1A

PLECTRUM AUXILIARY DEVICE FOR STRING MUSICAL INSTRUMENTS

BACKGROUND OF THE INVENTION

The present invention generally relates to musical instruments and particularly to means for playing string instruments such as guitar. More specifically the invention concerns an auxiliary device for holding plectrums by which the string instruments are played.

As a rule, plectrums are held by the player between the forefinger and the thumb and so plucked against the strings to produce the sound. This traditional arrangement has not been changed for centuries in spite of various improvements and modifications of the playing instruments proper, for example, the so-called "electric" guitar and its variations.

The object of the invention is to improve and make more efficient and convenient the very holding of the plectrum, thereby achieving more accuracy and less fatigue to the player.

A further object of the invention is to provide an auxiliary tool or holder to be conveniently gripped by the player, guided by human engineering considerations, for assuring safe grip and adaptation to various sizes of the player's palm.

SUMMARY OF THE INVENTION

Thus provided according to the present invention is a plectrum holding device for playing the guitar and the like string musical instruments, comprising an alongated body member; a butt-like rear member mounted to one end of the body member and configured to rest against the thumb root of the player; a trigger-like front member mounted to the other end of the body member and configured to be gripped by a forefinger phalanx of the player; and means for mounting a plectrum to the body member in a plane substantially perpendicular to the plane of the rear and front members within reach of the player's thumb at one side and the tip of the player's forefinger at the other side of said plectrum mounting means.

Preferably, the device comprises means for varying the distance between the rear and the front members, as well as their relative angular positions.

BRIEF DESCRIPTION OF THE DRAWINGS

These and additional constructional features and advantages of the invention will become more clearly apprehended in the light of the following description of a preferred embodiment thereof, given by way of example only with reference to the accompanying drawings, wherein FIG. 1 is a schematic perspective view of the plectrum holder featuring the characteristics of the present invention;

FIG. 1A is a detail of FIG. 1;

DETAILED DESCRIPTION OF THE PREFERRED EMBODIMENT

Figure 2A:
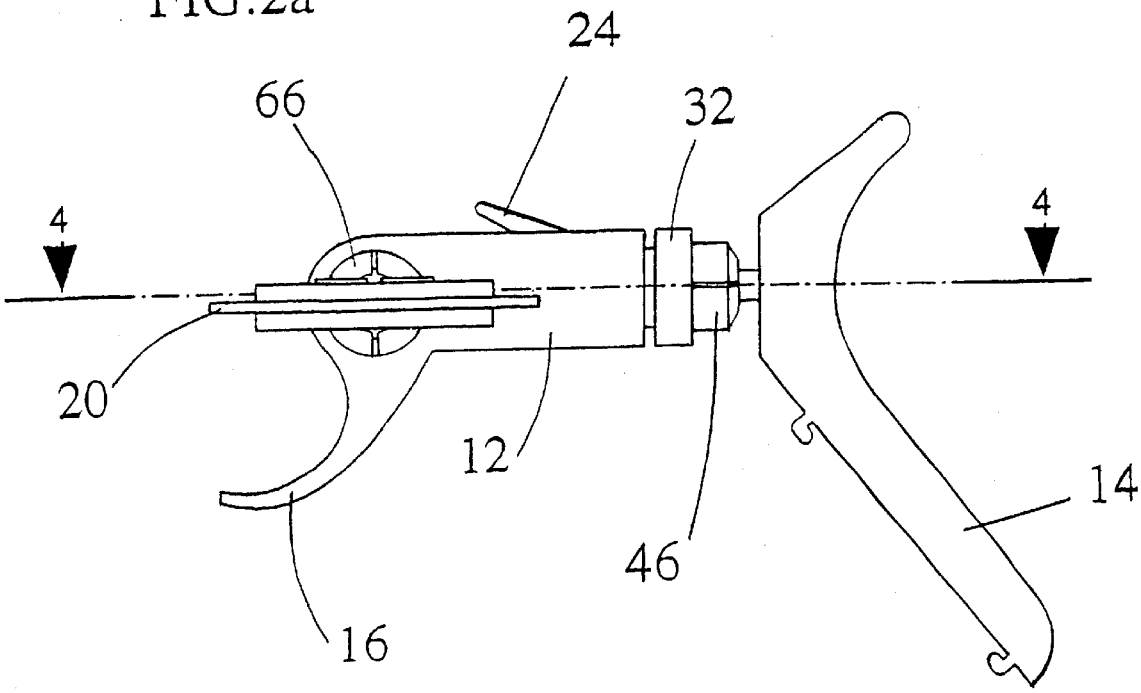
FIG. 2*a* is one side-view of the holder of FIG. 1.
Figure 2B:
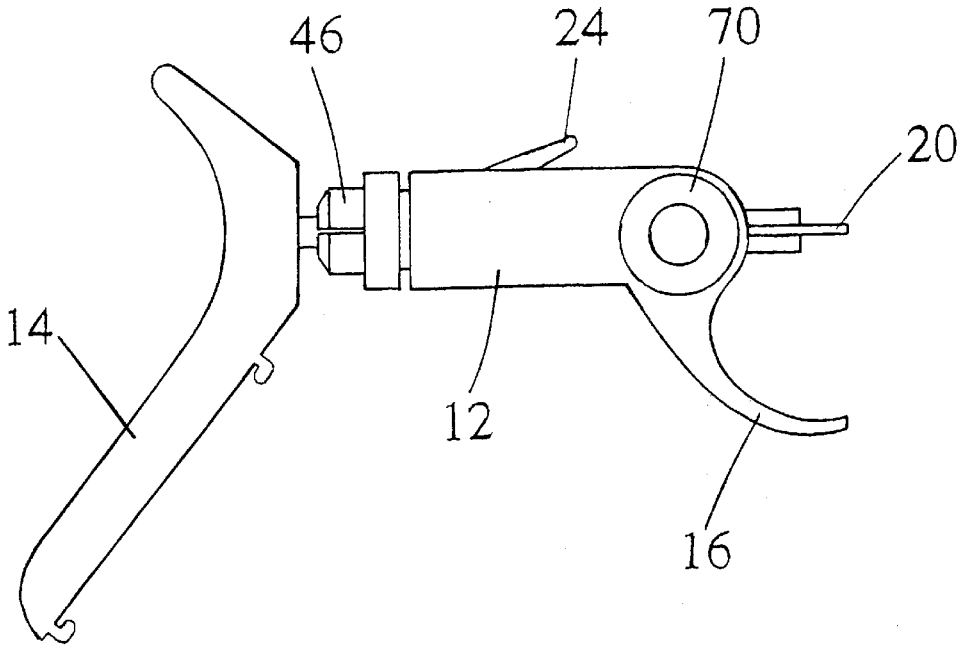
FIG. 2*b* is an opposite side-view of the holder of FIG. 2*a;*

As seen in FIG. 1, the plectrum holder generally denoted 10 comprises a central elongated body portion generally denoted 12 having a rectangular cross section with a top surface and side surfaces; a rear, butt-like rest generally denoted 14; a front, trigger-like finger grip portion 16; a plectrum mounting unit denoted 18; plectrum 20; and an optional switching attachment denoted 22 for controlling remote electronic or sound systems such as "MIDI" devices or "Guitar effects".

As will be explained in more detail below, the butt-like portion 14 is swivable in all directions, as well as extractable from and withdrawn into the body portion 12 using adjusting lever 24, the plectrum clamping unit 18 is also swivable, so that the holder 10, as a whole, is readily adjustable to any individual requirement of the user.

Figure 5:
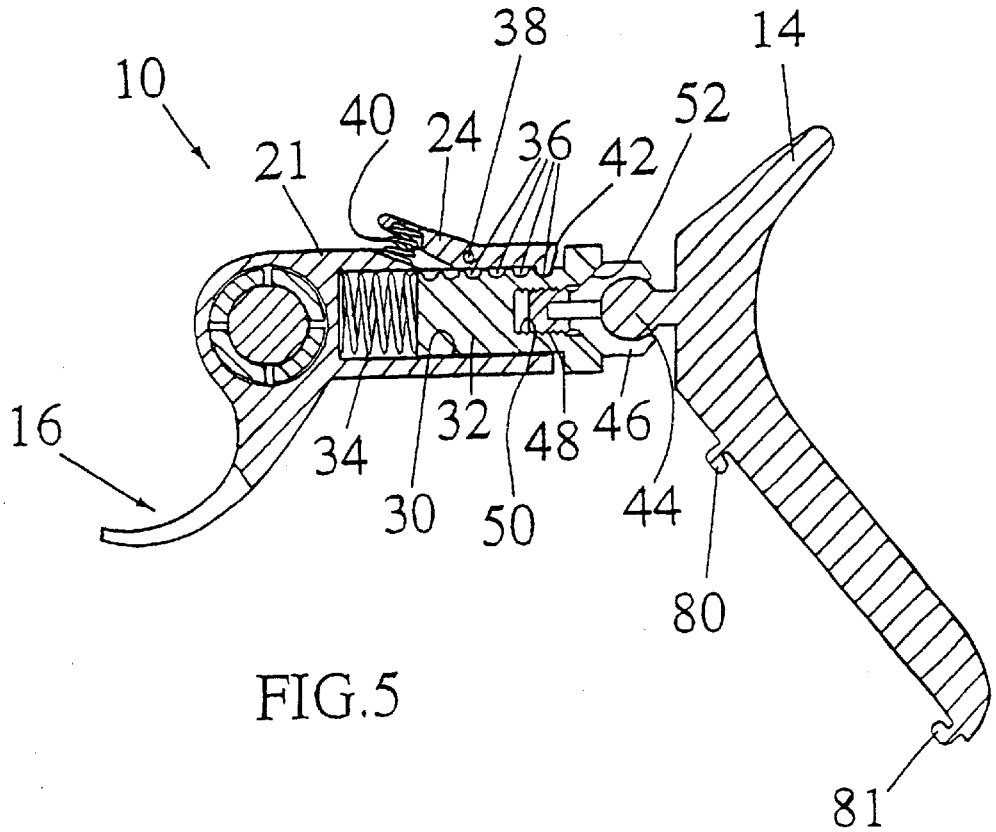
FIG. 5 is a section taken along line 5—5 of FIG. 3.

As further seen in FIG. 5, the body portion 12 is provided with blind bore 30 into which freely fits an insert 32 constantly pushed away by coil spring 34. The insert 32 has a series of notches 36 whereas the adjusting lever 24, pivotable about pin 38 and biased by spring 40, is provided with detent 42 which, in the position shown, fits into the first of the notches 36. In this position therefore the insert 32 is in its extreme withdrawn position, namely the length of the holder 10 as a whole is minimum. It will be thus readily understood that by operating the lever 24 and allowing the insert 32 to become extracted from the bore 30, the length of the holder 10 can be gradually increased;

The rear member 14 is coupled to the body 12 intermediate a ball-and-socket joint arrangement, comprising a spherical male portion 44, nested within a slotted springy seat member 46.

The member 46 comprises an extension 48, screw-thread received by bore 50 Mating wedge surfaces 52 enable the tightening of the seat 46 over the spherical male portion 44 at any desired angular position of the rear member 14.

Figure 3:
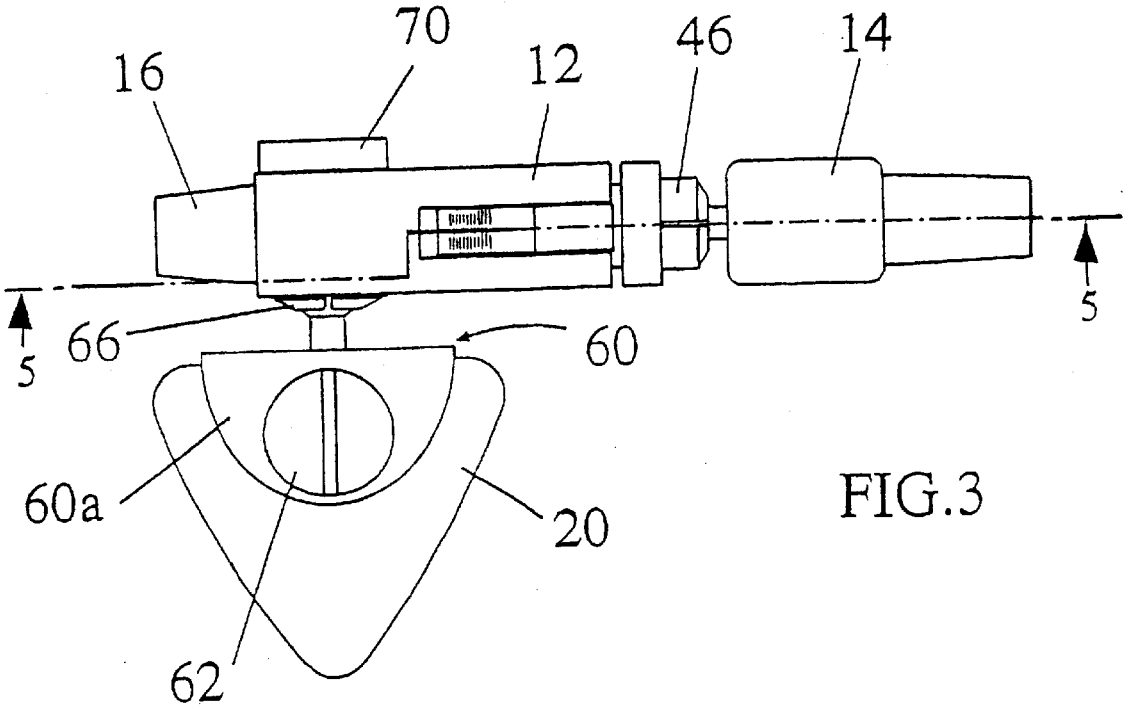
FIG. 3 is a top-view of the holder of FIG. 2*a;*
Figure 4:
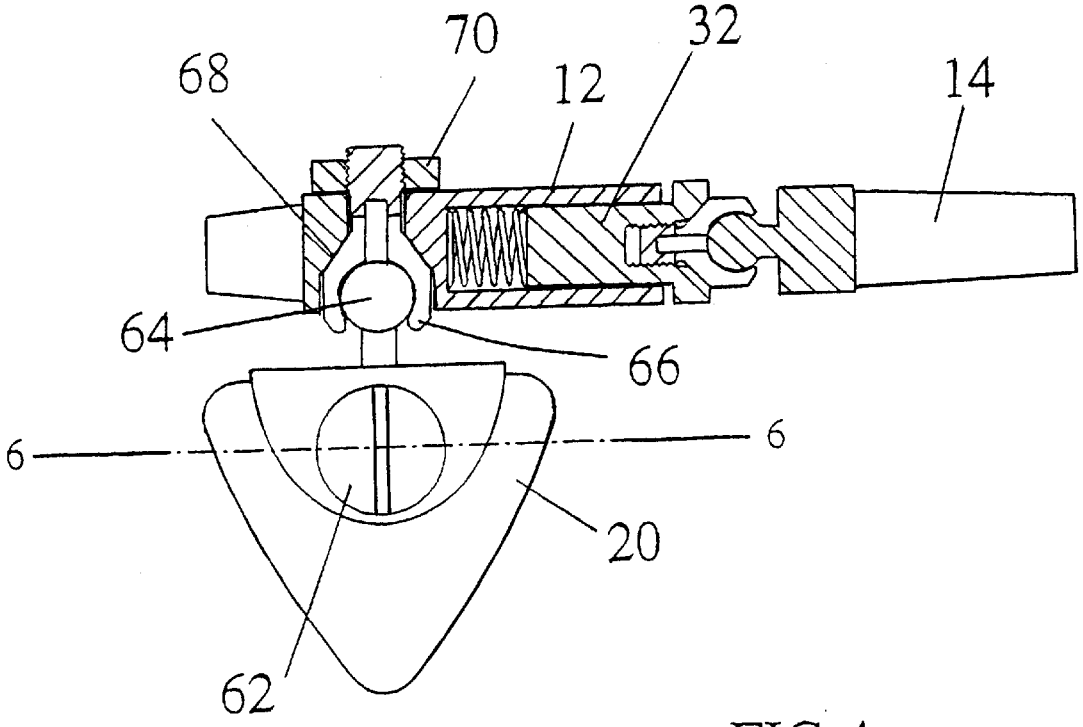
FIG. 4 is a section taken along line 4—4 of FIG. 2*a;*
Figure 6:
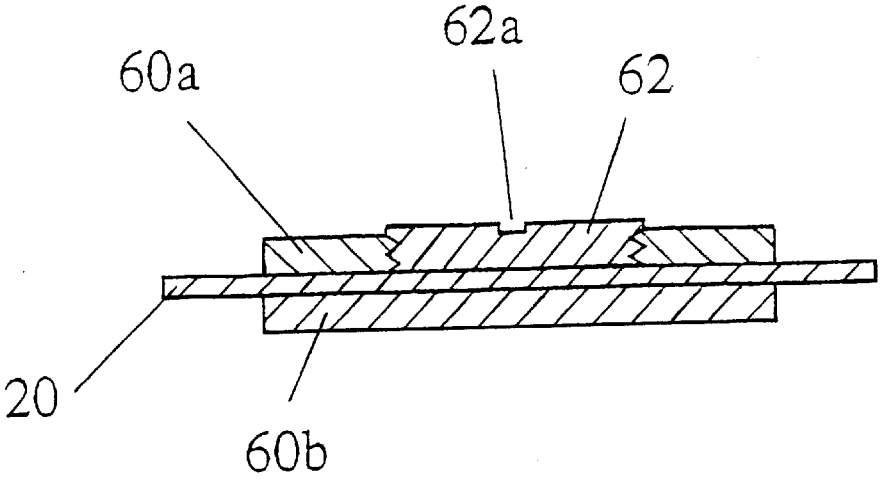
FIG. 6 is section taken along line 6—6 of FIG. 4.

The plectrum clamping device 18, extending sidewise from the front side of the body 12, comprises a tweezer-like holder (see FIGS. 3, 4 and 6) having two spaced parallel jaws 60*a* and 60*b* between which the plectrum 20 can be inserted and filmy fastened by a stud-screw 62, using screw driver slot 62*a*.

The jaws element 60 is extended by a spherical projection 64 springly received within slotted joint member 66 similar to the arrangement regarding the mounting of the rear side body portion 14. Hence, conical wedge cam surface 68 is used to firmly fasten the spherical projection 64 within the joint 66 by tightening knob 70 at the other side of the body 12. Thus, the plectrum is readily swivable in al directions within the seat of the sphere 64, The plectrum proper is easily replacable by slackening the stud screw 62 and refastening it with a replacement plectrum 20.

Finally, the electronic switching unit 22 with operating buttons 22*a*, 22*b*, etc., is attached to the portion 14 in any suitable manner such as profiled ribs 80 and 81 matching into counter-slots 80*a* and 81*a* as clearly seen in FIG. 1A.

Figure 7:
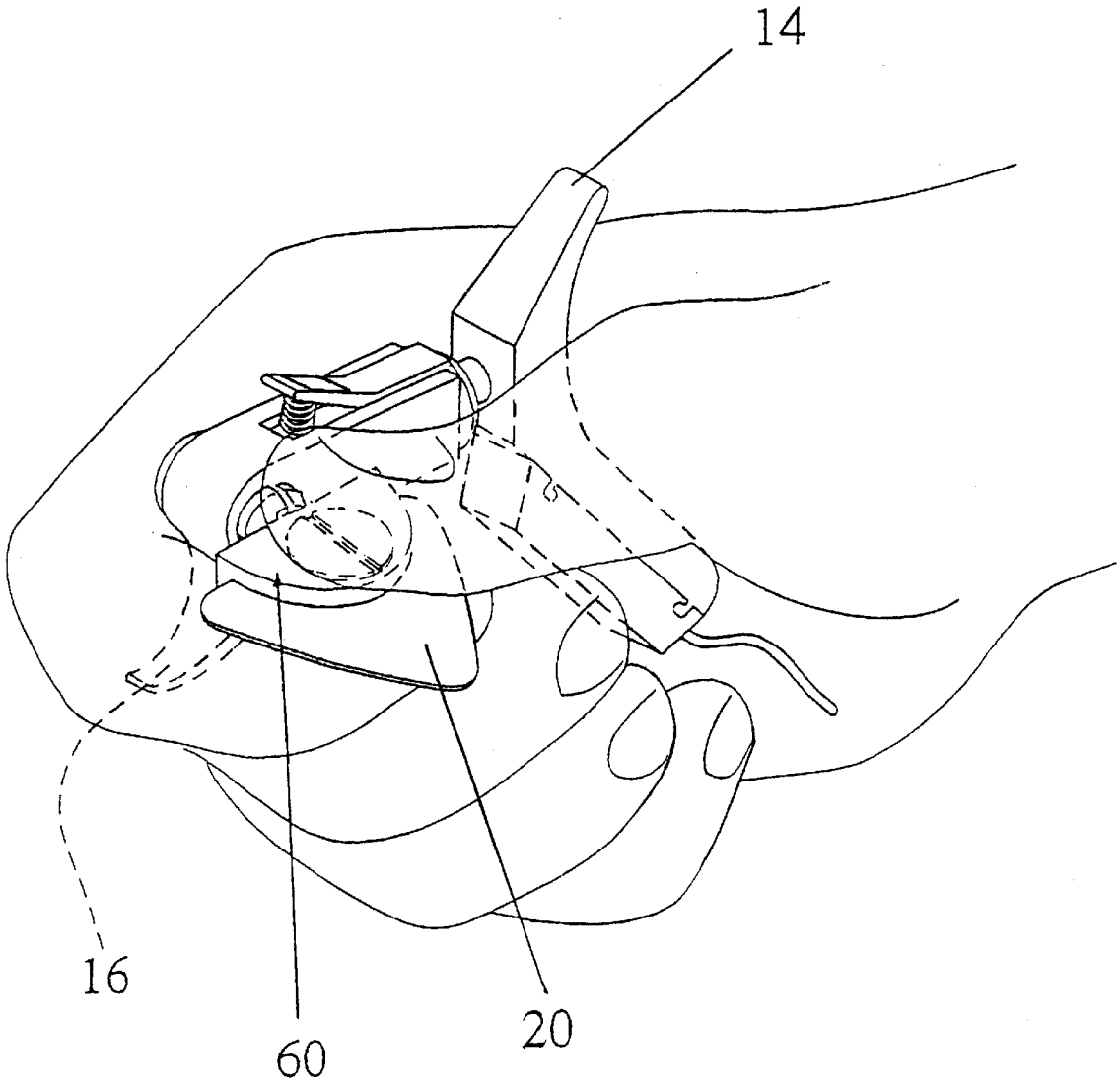
FIG. 7 illustrates the mode of use of a plectrum holder of FIG. 1.

The manner by which the plectrum holder 10 is used is clearly illustrated in FIG. 7, namely that th;.auxiliary device is gripped by the player's hand so that the rear portion 14 rests against the root of the thumb of the user, while the tip of the thumb presses from above on top of the plectrum mounting element 60, whereas the forefinger is crooked so that the second phalanx grips the portion 16 while the finger tip reaches from below against the lower side of the mounting 60. Thus achieved is the safe and secure gripping of the holder 10 with the plectrum 20, without interfering with the normal playing routine in the conventional manner.

The electronic switching attachment 22 is accessable by the tips of the other fingers of the user to operate push button switches 22*a*, 22*b*, etc., to control the desirable musical effects.

While the above description contains many specificities, these should not be construed as limitations on the scope of the invention, but rather as exemplification of the, preferred embodiments. Those skilled in the art will envision other possible variations that are within its scope. Accordingly, the scope of the invention should be determined not by the embodiment illustrated, but by the appended claims and their legal equivalents.

What is claimed is:

1. A plectrum holding device for playing guitar and string musical instruments, comprising:

an elongated body member having a top surface and side surfaces;

a butt-like rear member mounted to one end of the body member and configured to rest against the thumb root of the player;

a trigger-like front member mounted to an other end of the body member and configured to be gripped by a forefinger phalanxankle of the player; and means for mounting a plectrum to the body member in a plane substantially perpendicular to one of the side surfaces of the body member.

2. The device of claim 1 further comprising means for varying the distance between the rear and the front members.

3. The device of claim 1 further comprising means for varying the angular position of the rear member relative to the axis of the body member.

4. The device of claim 1 further comprising means for varying the angular position of the plectrum mounting means relative to the longitudinal axis of the body member.

5. The device of claim 2 wherein the distance varying means comprise a step-wise elongating device.

6. The device of claim 5 wherein the step-wise elongating device comprises an insert seated within a bore formed in the body member, a series of notches in the insert, and an externally accessible, spring-urged lever with a detent configured to penetrate one of the series of notches.

7. The device of claim 2 wherein the means for varying the angular position of the rear member comprise a ball-and-socket coupling, with selectively operable tightening means.

8. The device of claim 2 wherein the means for varying the angular position of the front member comprise a ball-and-socket coupling, with selectively operable tightening means.

9. The device of claim 1 wherein the plectrum mounting means comprise a pair of opposite jaws between which a standard plectrum is insertable, and means for tightening the plectrum therebetween.

10. The device of claim 1 further comprising an electric switching device mounted to the rear member accessible for operation by the tips of the other of the player's fingers.

11. The device of claim 10 wherein the switching device is detachable from the rear member.

* * * * *